United States Patent [19]

Sankey et al.

[11] 4,038,765

[45] Aug. 2, 1977

[54] BOOM SUPPORT STRUCTURE FOR WALKING DRAGLINE EXCAVATOR

[75] Inventors: Edwin W. Sankey; Kenneth L. Barden, both of Marion; Paul Ruch, Nussbaumen, all of Ohio

[73] Assignee: Marion Power Shovel Company, Inc., Marion, Ohio

[21] Appl. No.: 517,400

[22] Filed: Oct. 23, 1974

Related U.S. Application Data

[63] Continuation of Ser. No. 427,428, Dec. 21, 1973, abandoned, which is a continuation of Ser. No. 120,167, March 2, 1971, abandoned.

[51] Int. Cl.[2] ..... E02F 3/48; E02F 9/14; B66C 23/62

[52] U.S. Cl. ..... 37/116; 212/38; 212/49; 212/59 R; 212/69; 212/144

[58] Field of Search ..... 37/115–117, 37/1, 135, 136; 212/40, 41, 58 A, 59 R, 61, 65, 69, 38 R, 47–49, 54, 57, 58 R, 144, 28, 29, 38, 42, 43, 44, 46 R, 46 A, 64, 66, 67, 70; 254/190; 214/132

[56] References Cited

U.S. PATENT DOCUMENTS

| | | | |
|---|---|---|---|
| 515,025 | 2/1894 | Sellers et al. | 212/38 |
| 946,899 | 1/1910 | Hayward | 37/117 X |
| 1,248,600 | 12/1917 | Bathrick | 37/116 |
| 1,316,058 | 9/1919 | Pugh | 37/136 |
| 1,511,437 | 10/1924 | Bager et al. | 214/132 |
| 1,886,032 | 11/1932 | Lotte | 212/38 |
| 1,917,955 | 7/1933 | Dierks | 37/116 |
| 1,962,777 | 6/1934 | Kersting | 212/46 R |
| 2,255,568 | 9/1941 | Page | 212/59 R |
| 2,256,982 | 9/1941 | Lawler | 254/190 R |
| 2,529,200 | 11/1950 | Swanson | 212/69 X |
| 2,805,781 | 9/1957 | Senn | 212/58 A |
| 2,888,150 | 5/1959 | Fox | 212/58 |
| 3,508,667 | 4/1970 | Commora | 212/58 R |

FOREIGN PATENT DOCUMENTS

| | | | |
|---|---|---|---|
| 1,241,074 | 5/1967 | Germany | 212/58 |

OTHER PUBLICATIONS

Schield Bantom Co., Waverly Iowa, Catalog No. 350, July 18,1959.

American Revolver Cranes, Form No. 400-RS-15-62 American Hoist & Derrick Company.

*Primary Examiner*—Clifford D. Crowder
*Assistant Examiner*—Steven A. Bratlie
*Attorney, Agent, or Firm*—Mason, Fenwick & Lawrence

[57] ABSTRACT

An improved boom support for a walking dragline excavator having a roller circle, a frame mounted on the roller circle for swing movement about the axis of the roller circle, a boom having a pair of boom feet connected to a front end of the frame and proximate to a segment of the roller circle, a hoist line connected to hoist machinery on the frame and passing over a point on the boom, a bucket connected to the hoist line, a dragline interconnecting the bucket and drag machinery on the frame, the front end of the frame having insufficient stiffness for adequately resisting deflection and substantially uniformly distributing the boom weight and hoist load imposed thereon over a segment of the roller circle disposed beneath the front end of the frame, the boom support including an upright structure having an upper end and a pair of legs connected to the frame, the upper end of the upright structure being connected to the pendants and to the frame rearwardly of the leg connections, the leg connections of the upright structure being disposed intermediate the boom feet connections, proximate to a segment of the roller circle, and spaced arcuately from the boom feet connections, the leg connections of the upright structure being separate from and independent of the boom feet connections.

18 Claims, 4 Drawing Figures

INVENTORS

EDWIN W. SANKEY,
KENNETH L. BARDEN &
PAUL RUCH

BY Mason, Fenwick & Lawrence
ATTORNEYS

INVENTORS
EDWIN W. SANKEY,
KENNETH L. BARDEN &
PAUL RUCH

BY
Mason, Fenwick & Lawrence
ATTORNEYS

INVENTORS

EDWIN W. SANKEY,
KENNETH L. BARDEN &
PAUL RUCH

BY
Mason, Fenwick & Lawrence
ATTORNEYS

BOOM SUPPORT STRUCTURE FOR WALKING DRAGLINE EXCAVATOR

This is a continuation of application Ser. No. 427,428, filed Dec. 21, 1973 now abandoned, which was a continuation of Ser. No. 120,167 filed Mar. 2, 1971 now abandoned.

BACKGROUND OF THE INVENTION

This invention relates to improved and simplified boom support structure for large dragline excavators.

In the past, a gantry has been mounted upon a deck, or main frame, of an excavating machine, with the gantry rising upwardly from the deck to support a boom by means of tension members running generally from the top of the gantry to the point of the boom. The gantry consists of front and back legs connected to the deck, with the front legs rising substantially vertically and the point of intersection of the front and back legs defining the top to which the boom-supporting tension members are connected. The boom has its foot secured at widely spaced points on the deck, usually directly over the circular rail beneath the frame which rests upon a circle of rollers to allow the main frame to swing, or rotate, about a vertical axis. The gantry front legs are widespread, and are mounted to the deck closely adjacent the boom foot pins.

With the gantry and boom structure just described, excessive loading occurs at the locations of the boom foot pins and gantry front leg mountings, which causes increased wear and pitting of the rollers and rail circle at the points of excessive loading. The front end of the main frame has insufficient stiffness for adequately resisting deflection and uniformly distributing the boom weight and hoist load imposed thereon over a segment of roller circle disposed beneath the front end of the main frame. At the front center area of the rail circle, there is little or no loading due to main frame deflection. This uneven distribution of weight and load results in uneven wear and inefficient operation.

A gantry such as described must be erected piece by piece in the field. This means that such fitting and welding has to be done at high elevations, and a large derrick is needed for long periods of time in placing small items in the upper portions of the gantry. This method is expensive and time consuming.

In large draglines, it is customary to employ some form of fairlead assembly to direct the drag ropes from the bucket to the drum so as to prevent the ropes from unnecessary wear by scraping against stationary surfaces, or by excessive flight angles with respect to the sheaves or drum. These have taken different forms, and with one form, known as the over and under fairlead, the fairlead and hoist deflecting sheaves are mounted in a tower, with the top of the tower being pinned to the front legs of the gantry and the tower bottom being connected to the excavator deck, or main frame. Unfortunately, the gantry is complicated by extensive truss structure just below the house roof to support rails for traveling cranes inside the house, which cranes are used for lifting and moving equipment. A further complication arises from the fact that the gantry front legs, at least in part, are within the house, requiring flashing at the points of exit to avoid water leakage. These factors contribute to the difficulty in suitably locating the fairlead tower top relative to the gantry. In addition, the gantry and fairlead tower require multiple points of attachment to the deck on multiple axes.

The prior structure results in boom weight and hoist loads being taken by the gantry, while drag loads are taken by the fairlead tower. The use of the two structures for the separate loads causes complication, expense, and loss of peak operational performance.

SUMMARY OF THE INVENTION

The principal object of the present invention is to provide a single improved structure which will combine the functions formerly served by separate structures; namely, the gantry and the fairlead tower.

A more specific object is to provide a single structure which will perform separate machine functions which do not normally occur at the same time in machine operation.

Another object is the provision of a gantry having its front legs serving as the mounting structure for the sheaves of a drag line fairlead.

A further object is to provide a gantry which has its front legs so spaced that connection to the excavator deck will be at locations well separated from the connections of the widespread boom foot so that the load is more evenly distributed to the roller circle.

Yet another object of the invention is to provide gantry structure which has its center of gravity close to the vertical rotation axis of the main frame.

Yet a further object is the provision of a gantry which can have its leg members assembled while the structure is nearly horizontal, so that only small cranes are required, and the assembled front and rear leg members can be raised and pinned together at their tops in single operation.

An object is to provide a gantry which includes the components of a fairlead system, yet is connected to the deck on only two axes in order to provide a clear deck area.

A still further object of the invention is to provide a structure wherein the rails supporting the traveling cranes within the house are carried by the house and have no connection to the gantry.

Other objects of the invention will become apparent from the following description of one practical embodiment thereof, when taken in conjunction with the drawings which accompany, and form part of, this specification.

DESCRIPTION OF THE PREFERRED EMBODIMENT

Figure 1:
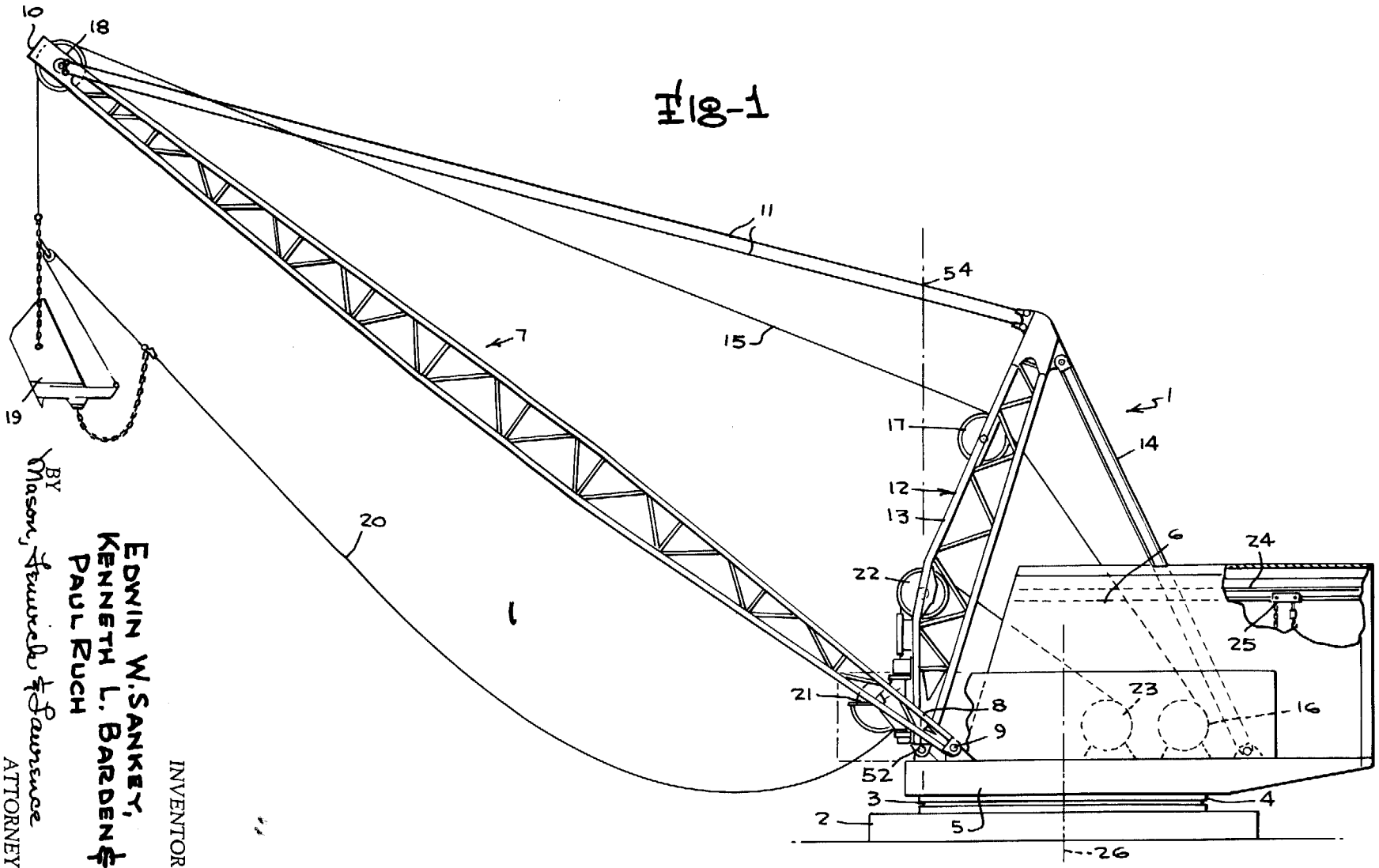
FIG. 1 is a side elevation of a dragline excavator having the improved gantry structure.
Figure 2:
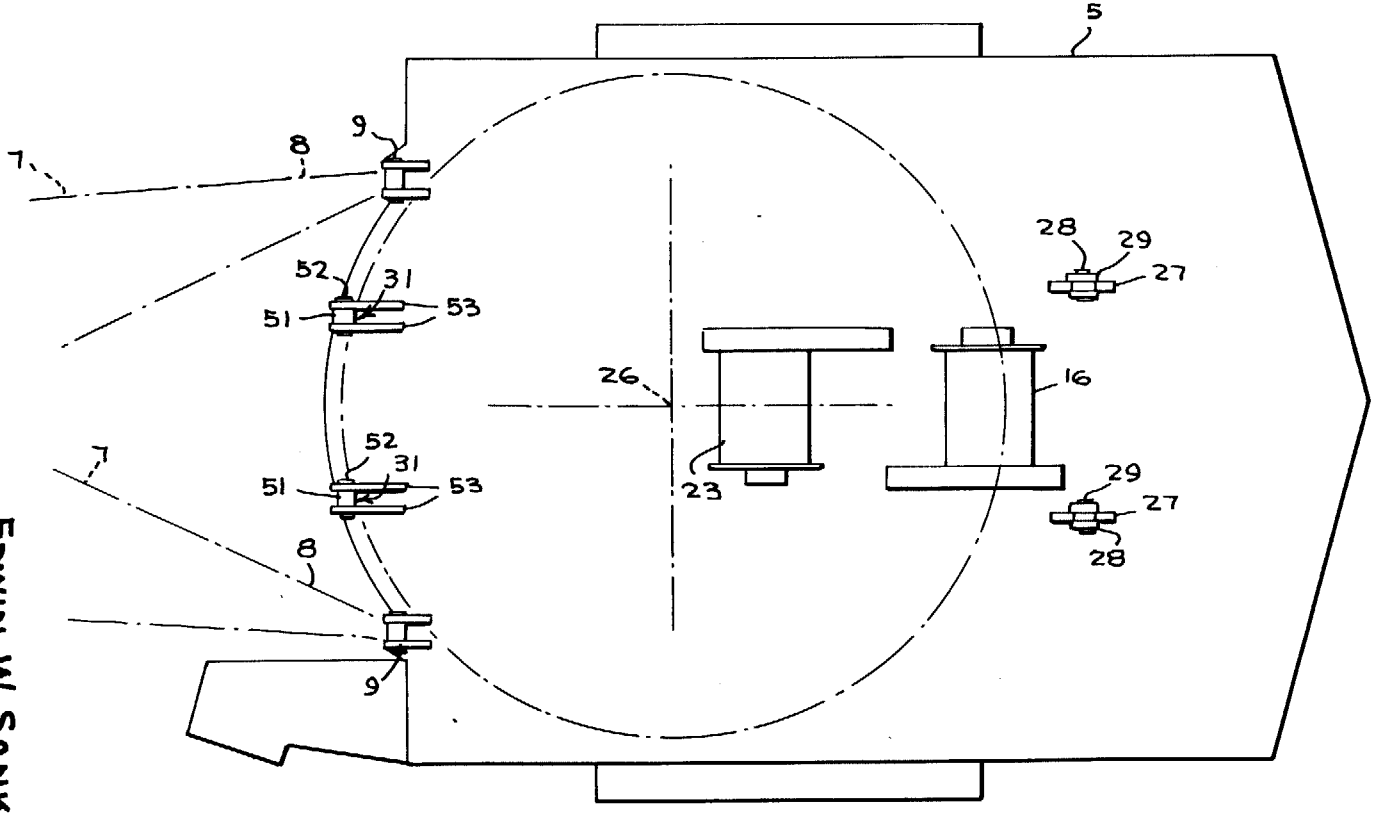
FIG. 2 is a plan view of the main frame, or deck, of the dragline, illustrating the boom point and gantry leg connections to the deck, as well as the vertical axis for swing movement of the frame.
Figures 3, 4:
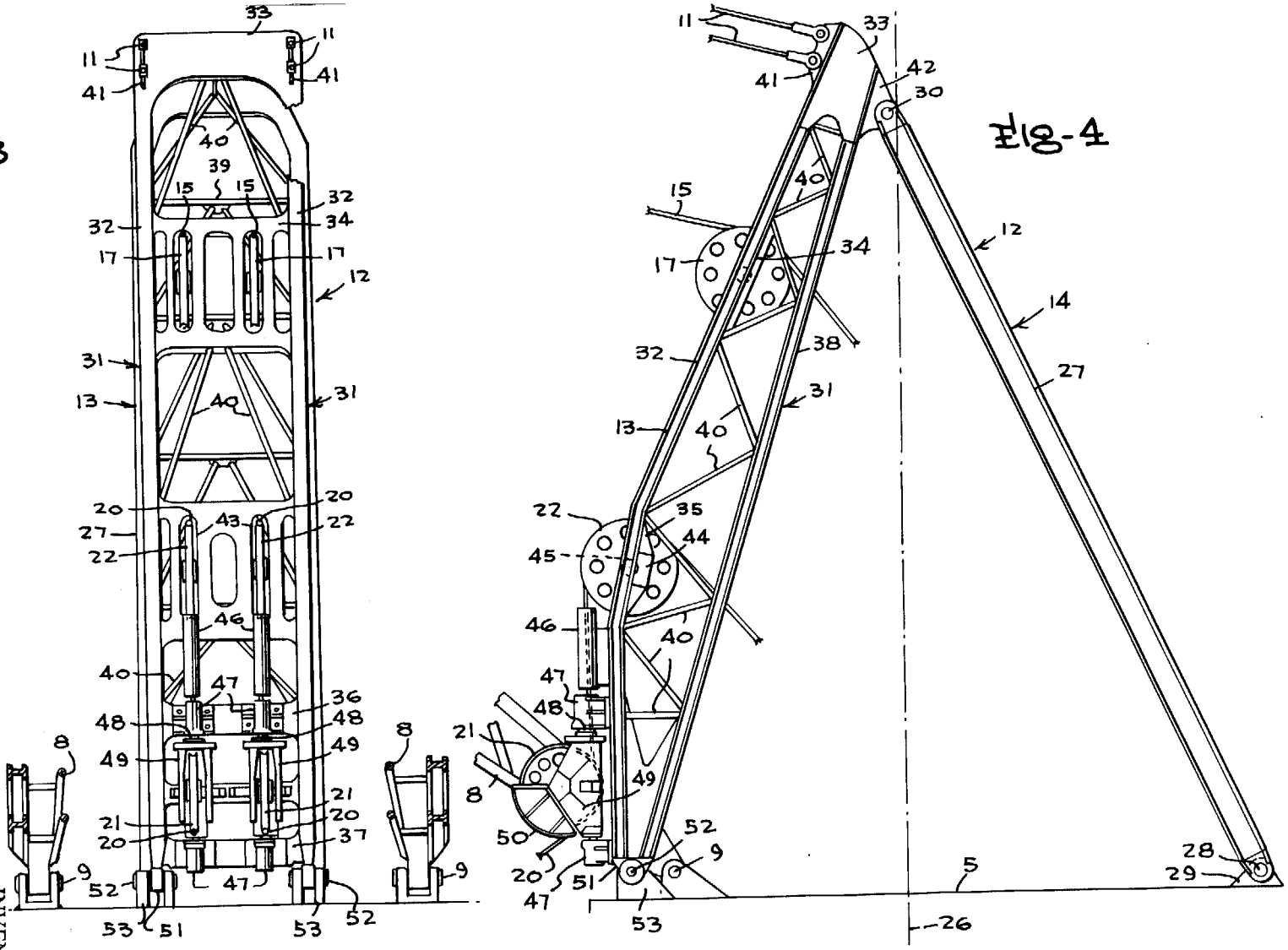
FIG. 3 is an enlarged front elevation of the gantry, with the deck level and boom foot connections being shown.
FIG. 4 is a side elevation of the structure shown in FIG. 3.

Referring to the drawings in detail, and first to FIG. 1, an excavator 1 of the dragline type is shown. The machine is mounted upon a tub 2 which rests upon the ground. The tub carries a circle of rollers 3 upon which a rail circle 4 rides. The rail circle is carried beneath the main frame, or deck of the machine. A house 6 is mounted upon the main frame and encloses the various ending drums and other machinery for operating the excavator. A boom 7 has its foot 8 attached by foot pins 9 to the deck of the main frame 5. The boom point 10 is suspended at a proper angle by means of pendants 11 having their opposite ends connected to the top of a gantry 12. The gantry has its front legs 13 and its rear legs 14 attached to the main frame as will be described in detail.

A hoist line 15 extends from a drum 16 within the house upwardly through the roof of the house and over a deflecting sheave 17 carried by the front legs of the gantry. The hoist line continues from here over a boom point sheave 18 and down to a bucket 19. A drag line 20 is connected to the bucket and extends rearwardly under a fairload sheave 21 and over a second fairlead sheave 22 and to a drag line drum 23 within the house 6. Operation of the hoist drum 16 raises and lowers the bucket, and operation of the drag line drum 23 draws the bucket toward the main frame, or pays out line to permit the bucket to return to its position of suspension beneath the boom point.

In the form shown, suitable rails are mounted within the house 6, just under the house roof, to provide supports for traveling cranes 25. These cranes will be mounted for movement longitudinally of the house, as well as transversely thereof to move and mount various pieces of equipment within the house.

As is customary with machines of this type, the main frame and house are rotatable about the roller circle 3 to provide traversing movement of the boom to swing the bucket from the digging position to a dumping position. The turning movement of the main frame is about a vertical axis 26 shown in dotted lines.

Gantry 12 is a triple function structure, with the front leg, or legs, 13 serving to transfer gantry boom loading to the main frame and, at the same time, serving as a mounting member, or tower, for the fairlead equipment as well as the hoist deflecting sheaves. The rear legs 14 can be any suitable tension members, and are shown as two, transversely spaced, parallel leg members 27, pinned to the deck, or main frame, on axially aligned transverse pins 28, which extend through the leg members and mounting brackets 29 carried on the deck, and at the top of the gantry to the front leg structure by pins 30.

The gantry front leg structure is in the form of a box-like tower, composed of a pair of transversely spaced trusses 31, having their front longitudinal beams 32 integrally connected by bridges 33, 34, 35, 36 and 37, and their rear longitudinal beams 38 interconnected by spacers. Suitable truss bracing 40 spans the front and rear longitudinal beams, or extends from the front longitudinal beams to the spacers between the rear longitudinal beams, as may be structurally desirable.

Bridge 33 is primarily a top connector for the trusses, but it carries forwardly extending ears 41, to which the gantry ends of the pendants 11 are attached. The bridge also has rearwardly projecting ears 42, to receive the pins 30 and connect the gantry front and rear leg members.

Bridge 34 not only braces the front leg trusses, but it also provides a mounting for the hoist line deflecting sheave 17. In the form shown, two deflecting sheaves are illustrated mounted side by side to support a pair of hoist lines, as is customary in large dragline construction.

Bridges 35, 36 and 37 provide bases for mounting fairlead structure to permit the gantry leg 13 to serve as both gantry leg and fairlead tower. To this end, the bridge 35 has vertical openings 43 to receive a pair of upper fairlead sheaves 22. Suitable bearings 44 are carried by the bridge to journal the ends of the sheave supporting shaft 45. Bridge 35 also carries a pair of vertically positioned guide tubes 46 aligned with the flight path of the drag line between the upper and lower fairlead sheaves 22 and 21. These tubes serve to guide, and maintain, the drag lines as they travel between the two fairlead sheaves.

The bridges 36 and 37 each have a pair of vertically extending bearings 47, with the bearings being spaced apart a distance equal to the spacing between the upper sheaves 22 and in transverse vertical alignment with those sheaves and the guide tubes 46. The bearings journal trunnions 48, positioned at the upper and lower ends of swivel frames 49. These frames carry the lower fairlead sheaves 21 and suitable swivel guards 50. This construction permits the lower fairlead sheaves 21 to swivel about the axis of the trunnions 48 to accommodate lateral movements of the drag line, yet maintain the flight of the drag line from the lower sheaves 21 to the upper sheaves 22 substantially constant.

Although the gantry front leg is shown, and has been described, as a single box-like tower, the side trusses 31 form the gantry front legs and each is provided at its bottom with a mounting eye 51 to receive pins which also pass through brackets 53 next to the deck of the excavator frame.

From the above, it will be seen that the new gantry construction is mounted upon the excavator frame on two axes, the common axis of the pins 52 forming the front axis, and the common axis of the pins 28 securing the back legs to the deck forming the rear axis. The location of the rear axis is not particularly important, except that it should be well back of the machine vertical turning axis 26. The rear legs of the gantry carry no weight in operation, as the boom load on the gantry causes the rear legs to be in tension. Therefore, the precise positioning of these back legs is not important, except that they should be well back of the rotational axis so that the tension in these legs will not be excessive and the rear end of the frame with its heavy ballast and machinery will be well supported.

The location of the front axis, however, is of great importance, and the location of the mounting points of the gantry front legs along that axis is also of great importance.

In normal dragline construction, the attachment of the boom foot to the main frame is at widely spaced points around the roller circle, to provide the requisite strength to withstand the transverse strains imposed during swinging action of the main frame boom. This imposes tremendous weights upon the rollers at the points of connection of the boom to the platform. Normally, the front legs of the gantry are connected to the main frame at points closely adjacent the attachment of the boom which adds the gantry loading to the boom weight at approximately the same locations. By using the box-like tower construction of the present gantry, and spacing apart the truss members 31 of that tower a distance less than half the width of the boom connections to the platform, the gantry loading upon the frame is distributed over an area spaced from, and intermediate of, the points of boom attachment, thereby effectively distributing these great loads about an appreciable arc of roller circle and preventing excessive loading at any localized area, or areas.

While optimum results are gained if the boom and gantry front legs are connected to the main frame at positions to divide the encompassed arc with the roller circle into thirds, major improvement in load distribution is obtained so long as the points of connection of the gantry front legs do not span a distance greater than one-half the distance between the points of boom connection to the frame.

Not only does the reduced spacing between the gantry front legs provide greatly improved load distribution about the roller circle, it also permits the formation of a front leg assembly of such over all dimensions that it can be transported in assembled form. Therefore, the front leg tower can be wholly assembled and machined in the shop, and transported to the erection site as a complete unit. This greatly increases the efficiency of production, for the gantry front leg can be assembled while in a substantially horizontal position, wholly eliminating the need for large cranes in the assembly operation, and allowing the assembly crew to work at ground level or slightly above ground level. As a result, assembly costs are greatly reduced.

In the assembly of the entire gantry, the rear legs can be pinned to the deck and propped at the required angle and the front leg structure can be pinned to the deck and then swung upwardly to the desired position. The front and back legs can then be assembled by simple insertion of the pins 30 to tie them together.

Another feature of the improved gantry is the location of the pins 30 with respect to the pin mountings 52 and 28 and the fact that axes of legs 13 and 14 intersect at a point closely adjacent vertical axis 26. In the embodiment shown, the top of the gantry has been moved back by inclining the front legs so that the top of the gantry is closely adjacent the vertical axis of rotation of the platform. By doing this, the center of gravity of the gantry weight is shifted back near the axis of rotation for better balance, and results in a reduction in the polar moment of inertia. In determining the point of connection of the front and rear legs, it is important that the angle of the pendants 11 with respect to the boom be maintained. Therefore, if the gantry front legs were vertical, as indicated by the dotted line 54 in FIG. 1. to improve the center of gravity location the gantry top would have to be shifted rearwadly and downwardly, along the angle of the pendants, to a position as shown in full lines in FIG. 1. This would elongate the pendants, but maintain the same angularity with respect to the boom. Therefore, the improved center of gravity location of the gantry can be accomplished while leaving the compressive load applied to the boom by the pendants unchanged. This change reduces the amount of ballast required to balance the boom and load, results in slighter shorter front legs for the gantry, and rear legs which are considerably shorter. At the same time, it improves the appearance of the over all structure, for the front of the house can be slanted rearwardly to correspond with the gantry front leg angle, and allow the entire massive girder-like construction of the gantry front leg to be exposed. This also eliminates the necessity for flashing, as was previously required in those areas where the gantry front legs projected through the house structure.

The optimum location of the gantry top with respect to the axes of connection to the frame can be located in a range of some area. For example, in a large dragline having a rotating main frame of approximately eighty-eight feet, with the distance from the center of rotation of the frame to the boom foot being approximately twenty-three feet, the location at the top of the gantry may be within the area of plus or minus fifteen feet fore or aft of the axis of rotation. If the gantry top is located outside of these limits, the results are now obtained are sharply reduced, for if the gantry top is moved forward of this range, the center of gravity is so far forward that the polar moment of inertia is increased, and if the point is moved too far back, the front leg truss will become excessively deep and its weight will begin to increase.

The improved gantry provides a front leg structure which, at the same time, provides support for all of the components of the over and under type fairlead. As the gantry loading is greatest during hoist operations, and the greatest fairlead loadings occur during drag line operations, the two operations are combined in a single structure without creating any excessive, or unusual strains in that structure. The points of connection of the entire assemblage has been reduced to connection along two axes spaced lengthwise of the rotating frame and the center of gravity of the gantry is at a nearly optimum position. The formation of the front legs as a box-like tower permits the front gantry legs to be located at points over the roller circle which results in more equal distribution of the boom and gantry loadings upon the rollers.

The improved gantry is not only usable where the boom pendants are connected directly to the gantry top, but is also applicable to those installations where the boom is exceptionally long and a mast is interposed between the boom and gantry. In these excavators, the gantry is connected to the mast tip, and the mast, in turn, is connected to the boom point.

While in the above one practical embodiment of the invention has been disclosed, it will be understood that the specific details of construction shown and described are merely by way of illustration, and the invention may take other forms within the scope of the appended claims.

We claim:

1. In a walking dragline excavator having a roller circle, a main frame mounted on said roller circle for swing movement about the central vertical swing axis of said roller circle, a boom provided with a pair of boom feet connected to a front end of said main frame forwardly of said central vertical swing axis and proximate to a segment of said roller circle, a hoist line operatively connected to hoist machinery mounted on said main frame and passing over and suspending from a point of said boom, a bucket operatively connected to a suspended portion of said hoist line, a drag line operatively interconnecting said bucket and drag machinery mounted on said main frame, the front end of said main frame having insufficient stiffness for adequately resisting deflection and substantially uniformly distributing the boom weight and hoist load imposed thereon over a segment of said roller circle disposed beneath the front end of said main frame, an improved means for supporting said boom by means of pendants and substantially uniformly distributing the boom weight and hoist load on said roller circle comprising an upright structure having an upper end and a pair of lower legs connected to said main frame, the upper end of said upright structure being operatively connected to said pendants and also being operatively connected to said main frame rearwardly of said lower leg connections, said lower leg connections of said upright structure being disposed intermediate said boom feet connections, proximate to a segment of said roller circle, and spaced arcuately from said boom feet connections, said lower leg connections of said upright structure being separate from and independent of said boom feet connections, whereby loads transmitted through said boom feet connections and the lower leg connections of said upright structure, and through the front end of said main frame to said roller circle, will be substantially uniformly distributed over a segment of said roller circle disposed beneath the front of said main frame.

2. An improved support means according to claim 1, wherein the arcuate spacing between said lower leg connections of said upright structure is no greater than one-half the arcuate spacing between said boom feet connections.

3. In a walking dragline excavator having a roller circle, a main frame mounted on said roller circle for swing movement about the central vertical swing axis of said roller circle, a boom provided with a pair of boom feet connected to a front end of said main frame, forwardly of said central vertical swing axis and proximate to a segment of said roller circle, a hoist line operatively connected to hoist machinery mounted on said main frame and passing over and extending from a point on said boom, a bucket operatively connected to a suspended portion of said hoist line, a dragline operatively interconnecting said bucket and drag machinery mounted on said main frame, the front end of said main frame having insufficient stiffness for adequately resisting deflection and substantially uniformly distributing the boom weight and hoist load imposed thereon over a segment of said roller circle disposed beneath the front end of said main frame, an improved gantry for supporting said boom by means of pendants and for transmitting the boom weight and hoist loads to said roller circle comprising a pair of front legs and at least one rear leg, said legs having lower ends connected to said main frame and upper ends operatively connected to form an upright structure, the connections of the lower ends of said gantry front legs to said main frame being disposed intermediate said boom feet connections, proximate to a segment of said roller circle, and spaced arcuately from said boom feet connections, and the connections of the lower end of the rear leg is spaced rearwardly of the front gantry leg connections, said gantry front leg connections being separate from and independent of said boom feet connections, whereby loads transmitted through said boom feet and gantry front leg connections and the front end of said main frame to said roller circle will be substantially uniformly distributed over a segment of said roller circle disposed beneath the front end of said main frame.

4. An improved gantry according to claim 3 wherein the spacing between the connections of the lower ends of said gantry front legs to said main frame is no greater than one-half the spacing between said boom feet connections.

5. An improved gantry according to claim 4 wherein the connections of the lower ends of said front gantry legs to the main frame are disposed on a transverse line disposed forwardly of said vertical swing axis, and the connection of the lower end of said rear gantry leg to the main frame is spaced rearwardly of said transverse line.

6. An improved gantry according to claim 4 wherein the connection of the upper ends of said front and rear gantry legs is at a point within 15 feet forwardly or rearwardly of said vertical swing axis.

7. An improved gantry according to claim 4 including a lower drag line fairlead sheave mounted on said front gantry legs, and an upper drag line fairlead sheave mounted on said gantry front legs above said lower fairlead sheave, and wherein said drag line passes under said lower fairlead sheave and over said upper fairlead sheave in passage to said drag machinery.

8. An improved gantry according to claim 7 wherein said lower fairlead sheave is mounted for swivel movement about a vertical axis.

9. An improved gantry according to claim 8 wherein the connections of the lower ends of said front gantry legs to the main frame lie on a transverse line disposed forwardly of said vertical swing axis, and the connection of the lower end of said rear gantry leg is spaced rearwardly of said transverse line.

10. A gantry according to claim 9 wherein the connection of the upper ends of said front and rear gantry legs is at a point within 15 feet forwardly or rearwardly of said vertical swing axis.

11. An improved gantry according to claim 3 including a lower drag line fairlead sheave mounted on said front gantry legs and an upper drag line fairlead sheave mounted on said front gantry legs above said lower fairlead sheave, and wherein said drag line passes under said lower fairlead sheave and over said upper fairlead sheave in passage to said drag machinery.

12. An improved gantry according to claim 11 wherein said lower fairlead sheave is mounted for swivel movement about a vertical axis.

13. An improved gantry according to claim 12 including means mounted on said front gantry legs intermediate said lower and upper fairlead sheaves for guiding a segment of said drag line between said lower and upper fairlead sheaves.

14. An improved gantry according to claim 11 wherein each of said front gantry legs comprises a truss, said trusses are interconnected by bridging members and said upper and lower fairlead sheaves are mounted on said bridging members.

15. An improved gantry according to claim 14 wherein the connection of the lower end of said rear gantry leg to said main frame is disposed rearwardly of said vertical swing axis.

16. An improved gantry according to claim 15 wherein the spacing between the connections of the lower ends of said gantry front legs to the main frame is no greater than one-half the spacing between said boom feet connections.

17. An improved gantry according to claim 16 wherein the connections of the lower ends of said front gantry legs lie on a transverse line disposed forwardly of said vertical swing axis, and the connection of the lower end of said rear gantry leg is disposed rearwardly of said transverse line.

18. An improved gantry according to claim 16 wherein the connection of the upper ends of said front and rear gantry legs is disposed at a point within 15 feet forwardly or rearwardly of said vertical swing axis.

* * * * *